United States Patent [19]

Forney, Jr. et al.

[11] Patent Number: 4,650,271

[45] Date of Patent: Mar. 17, 1987

[54] COAXIAL CONNECTOR WITH INTERLOCKED DIELECTRIC BODY

[75] Inventors: Edgar W. Forney, Jr., Harrisburg; Richard S. Hogendobler, Camp Hill, both of Pa.

[73] Assignee: AMP Incorporated, Harrisburg, Pa.

[21] Appl. No.: 765,623

[22] Filed: Aug. 14, 1985

[51] Int. Cl.[4] ..... H01R 17/18

[52] U.S. Cl. ..... 339/177 R; 339/275 R

[58] Field of Search ..... 339/177 R, 177 E, 143 R, 339/218 R, 218 M, 275 R, 136 R, 136 M

[56] References Cited

U.S. PATENT DOCUMENTS

| | | | |
|---|---|---|---|
| 3,292,117 | 12/1966 | Bryant et al. | 339/177 R |
| 3,870,978 | 3/1975 | Dreyer | 339/177 R |
| 4,022,518 | 5/1977 | Gattaz | 339/177 E |
| 4,266,844 | 5/1981 | Chelminski | 339/218 M |
| 4,334,730 | 6/1982 | Colwell et al. | 339/130 C |
| 4,572,605 | 2/1986 | Hess | 339/218 M |

FOREIGN PATENT DOCUMENTS

| | | | |
|---|---|---|---|
| 0877668 | 10/1981 | U.S.S.R. | 339/177 R |

*Primary Examiner*—Gil Weidenfeld
*Assistant Examiner*—David L. Pirlot
*Attorney, Agent, or Firm*—Gerald K. Kita

[57] ABSTRACT

According to the invention a coaxial connector comprises a conductive outer shell 2 for releasable connection with an electrical coaxial cable 7, a dielectric body 3 coaxially surrounded by the outer shell 2 with a compression fit, and a conductive center contact 4 coaxially surrounded by the dielectric body 3, a recess 27 in the periphery of the dielectric body 3 encircles the dielectric body 3 and is aligned with openings 25 extending through the thickness of the outer shell 2, and a solidifiable material 24 in the recess 27 adheres to the outer shell 2 to form a rigid collar 29 projecting radially inward to engage the dielectric body 3 and resist movement of the dielectric body 3.

6 Claims, 8 Drawing Figures

1
2
3
4
5
6
7
8
9
11
12
13
14
15
16
17
18

COAXIAL CONNECTOR WITH INTERLOCKED DIELECTRIC BODY

FIELD OF THE INVENTION

The invention relates to an electrical coaxial connector, and more specifically, a coaxial connector wherein the component parts are interlocked with one another to resist movement.

BACKGROUND OF THE INVENTION

U.S. Pat. No. 3,292,117 discloses a coaxial connector having component parts including, a conductive center contact coaxially surrounded by a dielectric body of insulation material, in turn, surrounded coaxially by a conductive shell for disengageable connection with an electrical coaxial cable. The component parts are interlocked by a pin constructed in the following manner. An opening extends through the thickness of the outer shell and is aligned with another opening which extends entirely through the dielectric body and intercepts the center contact. The aligned openings are filled with a fluent and solidifiable dielectric material such as epoxy. The epoxy then solidifies and forms a rigid pin which resists movement of the center contact and the dielectric body with respect to the outer shell.

In a coaxial connector according to the invention, a fluent and solidifiable material adheres to a conductive outer shell of the connector and is formed into a collar which resists movement of a dielectric body of the connector. The fluent material is deposited in a recess in the periphery of the dielectric body. The recess forms the collar to a precise small size and shape to minimize the impedance mismatch caused by presence of the collar in the connector. Further the collar is formed subsequent to assembly of the dielectric body within the outer shell. Thereby, the collar is positioned precisely and without contributing to an increase in cumulative tolerances in the assembly of the dielectric body and the outer shell.

According to the invention a coaxial connector is characterized in that, a dielectric body is coaxially surrounded by an outer shell with a compression fit, a recess in the periphery of the dielectric body encircles the dielectric body and is aligned with an opening extending through the thickness of the outer shell, and a solidifiable material in the recess adheres to the outer shell to form a rigid collar projecting radially inward to engage the dielectric body and resist movement of the dielectric body.

An object of the invention is to provide an electrical coaxial connector with interlocked component parts.

Another object of the invention is to provide a retention collar of dielectric material to minimize the effect on characteristic impedance while supplying superior retention.

Another object of the invention is to provide an electrical coaxial connector with component parts of the connector having interlocking features that are provided without contribution to cumulative tolerances in the assembly of the component parts.

Another object of the invention is to provide an electrical coaxial conector with a conductive outer shell and a dielectric body interlocked to the outer shell by a collar formed by a solidifiable material.

Other objects and advantages are present and are intended to be covered in the description of the invention and the accompanying drawings.

DESCRIPTION OF THE DRAWINGS

With reference to FIGS. 1 and 2 of the drawings, an electrical coaxial connector 1 includes a conductive outer shell 2, a dielectric body 3 and a conductive center contact 4. The outer shell 2 is cylindrical with an axial bore 5 and a forward mating end 6 for releasable connection with an electrical coaxial cable 7. In practice, external threads 8 on the mating end 6 are for threaded connection with acoaxial connector 9 assembled with the coaxial cable 7. The connector 9 is known from U.S. Pat. No. 4,070,751. The outer shell 2 has a flange 10 with apertures 11 through the thickness of the flange 10. The flange 10 is for mounting to a wall (not shown) with fasteners such as screws (not shown) held by the apertures and secured threadably in the wall. For example, the wall may be part of a housing that contains an electrical circuit path known as a strip line for carrying electrical signals of microwave frequency.

Figures 1, 2:
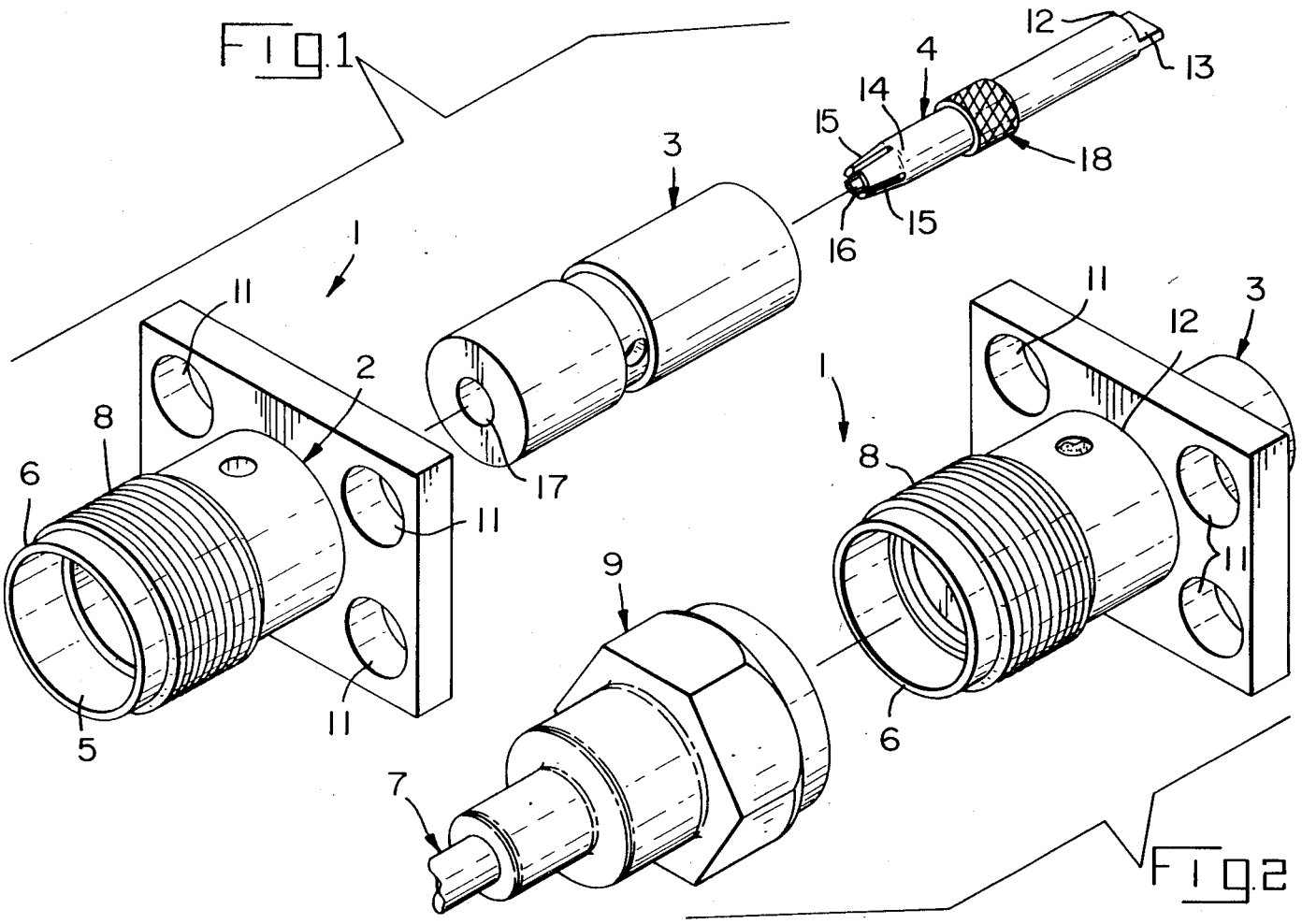
FIG. 1 is perspective view of an electrical coaxial connector according to the invention with parts illustrated in exploded configuration.
FIG. 2 is a perspective view of the parts assembled.

The center contact 4 has a rearward end 12 having a flat tab 13 extending axially of the center contact 4 and in a rearward direction of the connector 1 for connection to the strip line, for example, by the application of conductive solder. The center contact 4 is provided at its forward end with an electrical receptacle 14. The receptacle 14 has radially spaced apart fingers 15 extending toward the forward end of the connector 1. The fingers 15 are separated by slits 16 extending axially of the center contact 4 and communicating with the forward end of the contact 4. The receptacle 14 is for releasable connection with a center contact of the coaxial connector 9.

Figure 3:
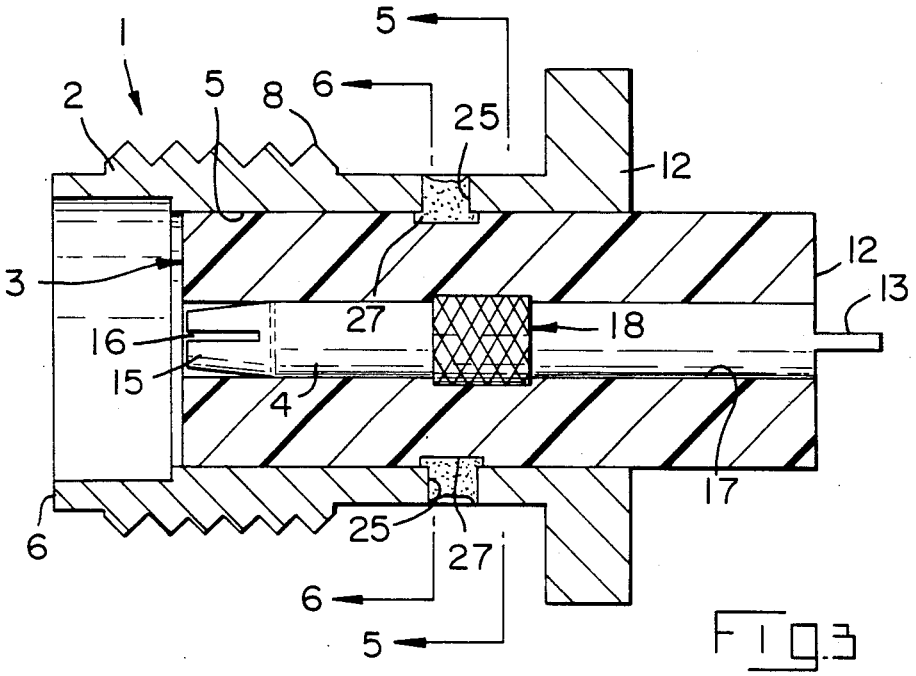
FIG. 3 is an elevation view in section of the parts assembled.
Figure 4:
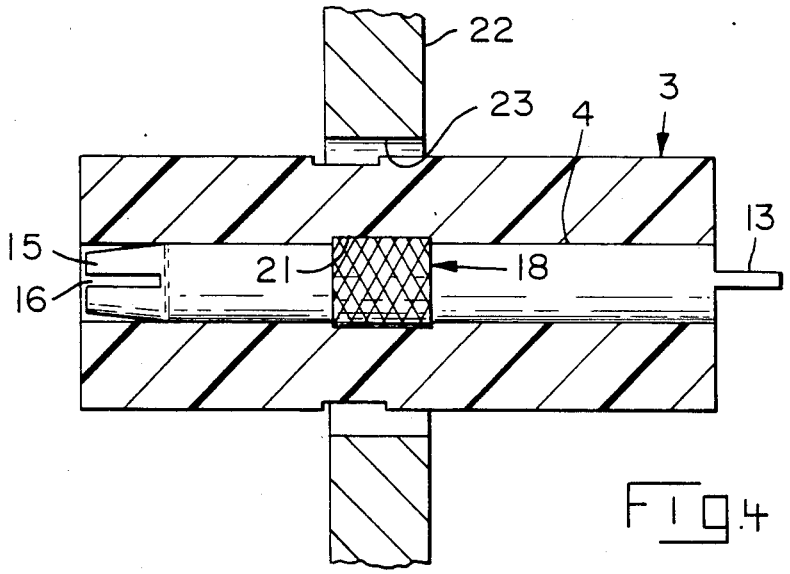
FIG. 4 is a diagrammatic view illustrating induction heating of a center contact and a dielectric body of the connector.
Figure 5:
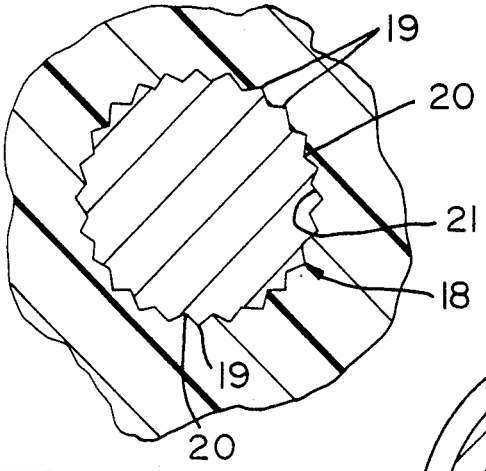
FIG. 5 is an enlarged partial section view taken along the line 5—5 of FIG. 3.

The dielectric body 3 has an axial bore 17. The center contact 4 is mounted in the bore 17 and is coaxially surrounded by the dielectric body 3. As shown in FIGS. 1, 3 and 4, a section of the external surface of the center contact has a roughened surface 18. For example, the roughened surface 18 is provided by knurling having a diamond pattern. FIG. 5 is an enlarged view illustrating the cross section of the knurling. The knurling has radially outward projections 19 and radially recessed portions 20. For example, the projections 19 will increase the nominal diameter of the center contact 4 by 0.004 inches, and the recessed portions will reduce the nominal diameter by 0.004 inches.

As shown in FIG. 4, the contact 4 is assembled in the bore 17 and the dielectric body 3 coaxially surrounds the contact 4 with a compression fit. The interior surface 21 of the dielectric body 3 is made to conform to the recessed portions 20 and projections 19 of the knurling in the following manner. A conductive metal plate 22 has an aperture 23 through its thickness. The assembled dielectric body 3 and center contact 4 is positioned in the aperture 23 with the knurling aligned with the thickness of the plate 22. The plate 22 is subjected to radio frequency energy, thereby inductively heating, or inducing a rise in temperature of, the surface of the knurling. The surface 21 of the dielectric 3 adjacent the knurling is then caused to change from a solid to a fluid state, and to flow into conformity with the recessed portions 20 and projections 19 of the knurling. Thereby the dielectric body 3 is flowed into interlocked engagement with the center contact 4. A suitable thermoplastic dielectric material which can be caused to flow by inductive heating is FEP fluoropolymer. The diamond knurling provides resistance to axial and rotational movement of the contact 4 with respect to the dielectric body 3.

The assembly of the dielectric body 3 and center contact 4 are assembled with the outer shell 1. The dielectric body 3 is coaxially surrounded by the outer shell 1 with a compression fit. The alignment of the dielectric body 3 and the outer shell 1 is adjusted. Then a solidifiable fluent material 24 such as epoxy is introduced into openings 25 diametrically opposed and extending through the thickness of the outer shell 2. The material 24 adheres to the interior surface 26 of the outer shell 2, and is deposited in a recess 27 in the periphery of the dielectric body 3 and encircling the dielectric body 3. Thereby the fluent material 24 fills the recess 27 and is flowed into interlocked engagement with the dielectric body 3. The recess 27 forms the material 24 into a solidified collar 29, which projects radially inward toward the axis of the dielectric body 3, and which is of precise small size and shape to minimize the impedance mismatch caused by presence of the collar 29 in the connector 1. Further the collar 29 is formed subsequent to assembly of the dielectric body 3 within the outer shell 2. Thereby, the collar 29 is positioned precisely and without contributing to an increase in cumulative tolerances in the assembly of the dielectric body 3 and the outer shell 2.

EXAMPLE

A dielectric body 3 having an outer diameter of 0.163 inches in diameter was coaxially assembled with a compression fit within a stainless steel outer shell 2 having a thickness of 0.025 inches. The dielectric body 3 had a shallow recess 27 having a depth of 0.004 inches and a width of 0.040 inches. The recess 27 communicated with diametrically opposed openings 25 through the outer shell 2. The diameter of each opening 25 was 0.030 inches. Nonconductive epoxy was introduced through one opening 25 and flowed by gravity and by wicking in two directions around the periphery of the dielectric body 3 and toward the other opening 25. The epoxy adhered to the outer shell 2 and formed a permanent collar 29 projecting into the recess 27 and encircling the entire periphery of the dielectric body 3 to provide maximum interlocked engagement that resist movement of the dielectric body 3.

Figure 6:
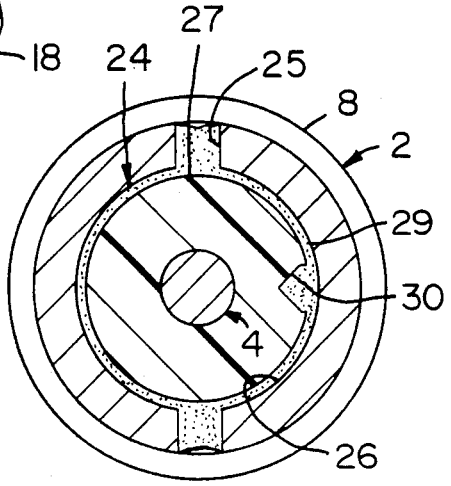
FIG. 6 is an enlarged section view taken along the line 6—6 of FIG. 3.

FIG. 6 shows a dielectric body 3 in which the recess 27 communicates with a radially inward extending recess 30 made by drilling radially into the dielectric body 3. The material 24 flows into interlocked engagement with the recess 30 as well as the recess 27.

Figure 7:
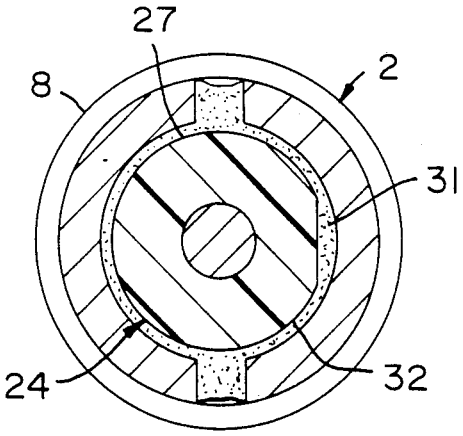
FIG. 7 is an enlarged section view similar to FIG. 6 and illustrating an alternative dielectric body.

FIG. 7 shows a dielectric body 3 in which the recess 27 has a linearly straight portion 31 intersecting an arcuate portion 32 which encircles the axis of the dielectric body. The material 24 flows into interlocked engagement with the straight and arcuate portions 31 and 32.

Figure 8:
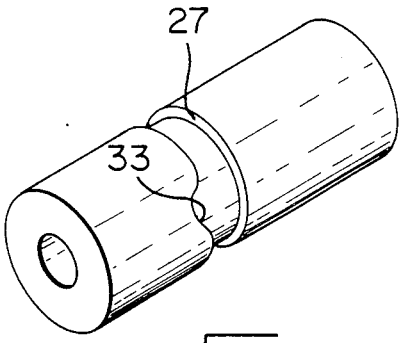
FIG. 8 is an enlarged perspective view of another alternative dielectric body.

FIG. 8 shows a dielectric body 3 with a recess 27 having a sinuous side wall 33. The material 24 flows into interlocked engagement with the sidewall 33.

Although a preferred form of the invention has been described, the claims are intended to cover modifications of the invention and other forms of the invention, for example, the material 24 can be a nonconductive epoxy or a conductive epoxy. The roughed surface 18 may be roughened by a technique other than knurling, or the knurling can be in a form other than diamond knurling.

We claim:

1. A coaxial connector comprising; a dielectric body coaxially surrounded by an outer shell with a compression fit, a conductive center contact coaxially surrounded by the dielectric body, a recess in and encircling the periphery of the dielectric body and facing the outer shell, an opening extending through the thickness of the outer shell and aligned with the recess, and a solidifiable material in the opening and filling the recess and adhering to the outer shell to form a rigid collar projecting radially inward to engage and encircle the dielectric body and resist movement of the dielectric body relative to the shell.

2. A coaxial connector as recited in claim 1, wherein, the recess has a curved side wall.

3. A coaxial connector as recited in claim 1, wherein, the recess has an arcuate portion and a straight portion intersecting the arcuate portion.

4. A coaxial connector as recited in claim 1, wherein, the dielectric body has a second recess in communication with the first recited recess, and the solidifiable material is in the second recess.

5. A coaxial connector as recited in claim 4, wherein, the second recess extends radially inward of the dielectric body.

6. A coaxial connector as recited in claims 1, 2, 3, 4 or 5, wherein, a portion of the center contact has a knurled surface axially offset from the recess, and a portion of the dielectric body is flowed into interlocked engagement with the knurled surface.

* * * * *